United States Patent [19]

Shepard et al.

[11] 4,030,709

[45] June 21, 1977

[54] METHOD OF PLUGGING TAPHOLES IN PHOSPHORUS FURNACES

[75] Inventors: E. Dwayne Shepard; Gordon H. Scherbel, both of Pocatello, Idaho

[73] Assignee: FMC Corporation, Philadelphia, Pa.

[22] Filed: Mar. 4, 1976

[21] Appl. No.: 663,845

[52] U.S. Cl. ..... 266/45; 266/272

[51] Int. Cl.[2] ..... C21B 7/12

[58] Field of Search ..... 266/44, 45, 271, 272

[56] References Cited

UNITED STATES PATENTS

| | | | |
|---|---|---|---|
| 3,124,854 | 3/1964 | Dore | 266/272 X |
| 3,262,692 | 7/1966 | Adams et al. | 266/271 X |
| 3,398,945 | 8/1968 | Walpole | 266/272 X |
| 3,540,627 | 11/1970 | Amrstend et al. | 266/272 X |
| 3,599,953 | 8/1971 | Smith | 266/45 |

*Primary Examiner*—Roy Lake
*Assistant Examiner*—Paul A. Bell
*Attorney, Agent, or Firm*—Robert D. Jackson; Frank Ianno

[57] ABSTRACT

A method of plugging phosphorus tapholes with a plug of matted ceramic fibers such as alumina-silica fibers wherein closure is effected by placing the ceramic plug, in the shape of a hollow cone, over a backing plug which is then inserted into the furnace taphole by means of a long handle attached to the base of the backing plug. The backing plug is maintained in place until molten furnace material solidifies against the plug thereby sealing off the taphole. Before the furnace is ready to be tapped, the backing plug is removed and the ceramic plug burned out with an oxygen lance.

4 Claims, 4 Drawing Figures

FIG. 1
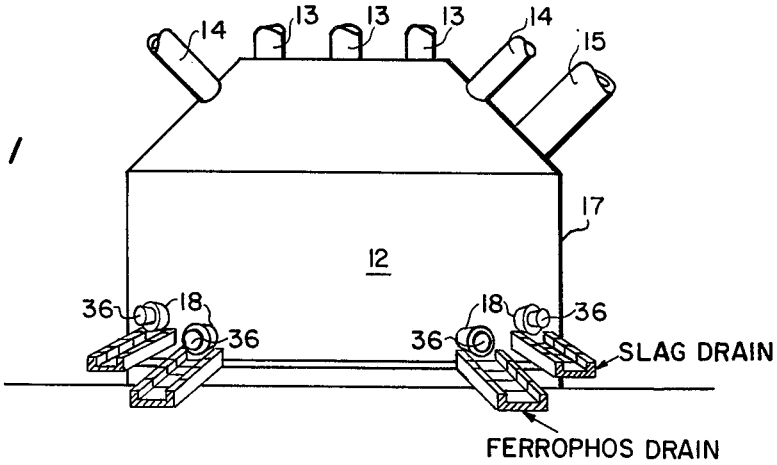
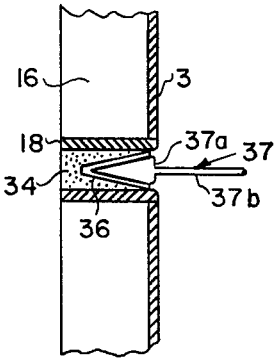
FIG. 2
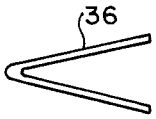
FIG. 3
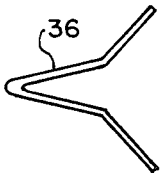
FIG. 4

METHOD OF PLUGGING TAPHOLES IN PHOSPHORUS FURNACES

This invention relates to electric phosphorus furnaces, particularly to improvements in tapping procedures.

Elemental phosphorus is produced by melting and reacting a mixture of phosphate ore, a carbon reductant such as coke and a flux such as silica rock in a submerged arc electric furnace. Phosphorus vapor is liberated from the molten material then collected and condensed to a liquid form. Remaining molten materials are ferrophos metal and slag separated by density and are periodically drained out through designated tapholes and introduced to cooling and disposal areas.

Tapping is a difficult operation due to high temperatures (2800° F) and the corrosive nature of the molten material and fumes. Prior tapping procedures require pneumatic rotary drills to break through hardened clay tap plugs and solidified material to allow the molten furnace contents to drain. Another method of opening taps include the use of an oxygen lance to burn through the clay or solidified materials. A further known method is to partially drill the hole open and then complete the tapping using an oxygen lance.

An oxygen lance is a long metal pipe through which is passed a stream of oxygen. On contact with an ignition source, the pipe end becomes incandescent by combusting with the oxygen to form a tip of deflagrating metal which burns out the clay plug, allowing the molten material to drain from the furnace. After drainage is completed, the furnace opening is closed with a fresh clay plug. Such clay plugs are fabricated in a mud mill situated near the furnace.

Plugging of tapholes with clay requires more than one man and because of close working proximity to the tapping operation the job can be hazardous. Clay plugs, with the correct moisture content, must be prepared in advance at each plugging. Use of clay plugs necessitates furnace load reductions and curtailments up to 10 minutes while the tap is being closed to minimize pressure from within the furnace and risk of injury. Electric power is generally paid for on a contract basis regardless of use and failure to utilize power demand is costly.

An improved method of plugging tapholes utilizes shaped green wooden plugs. These are inserted into the tapping sleeve at the end of a tap whereby the molten material adjacent to the plug solidifies stopping material flow. The wood portion is then converted into charcoal due to heat and absence of air.

Use of wooden plugs provide a simpler method of plugging and opening taps since predrilling of the tap is unnecessary. Burning out the charred plug with the oxygen lance is easier than with clay plugs resulting in less damage to the tapping sleeves and maintaining wood plug inventory is less of a problem.

However, wood plugs are not entirely satisfactory; they are more expensive than clay and load reductions may be needed to relieve furnace pressure. They are easier to insert, but personnel are still exposed to splattering molten material generated when moisture in the green wood turns to steam.

In accordance with the present invention, a method has been found of plugging tapholes in a phosphorus furnace comprising the steps:

a. providing a hollow plug member having walls of matted refractory ceramic fibers and conforming generally, at its point of contact, to the opening of the taphole, said member containing at least one hollow end, and adapted to receive a supportive backing plug through said hollow end;

b. placing the hollow plug member over a rigid, heat resistant supportive backing plug adapted to make contact with the inner surface of the hollow plug member;

c. inserting the hollow plug member while mounted on the supportive backing plug into the taphole and applying sufficient force to effect a seal between the outer walls of said hollow plug member and taphole opening, and d. retaining the backing plug in place until sufficient molten furnace material solidifies against the hollow plug member thereby plugging the taphole.

The tapping plugs of the present invention are formed from ceramic refractory fibers and are a known class of vitreous insulating materials having applications at temperatures exceeding 2000° F. For all practical purposes, such fibers include three broad categories: alumina-silica fibers and chemical modifications thereof; high-silica leached and fired glass fibers up to 99%+ silica and flame-attenuated silica fibers. Less common are alumina ($Al_2O_3$) and zirconia ($ZrO_2$) fibers. Due to their relatively low cost, the alumina-silica (kaolin) fibers are produced commercially and in fact make up the bulk of the refractory fiber market.

Refractory fibers are manufactured by forming a melt of the bulk mineral material and then fiberizing the melt by means of such techniques as steam-blowing and spinning. The raw fibers may contain considerable pellet or shot which should be removed where high thermal efficiency is required.

Refractory fibers can be fabricated into numerous configurations such as batts, blocks, boards, rope, textile forms, paper, tubing, cements, castables and spray coatings. A particularly useful and commercially important technique for obtaining refractory shapes is that of vacuum-forming. This is carried out by feeding loose fiber into water containing organic and inorganic binding agents.

The diluted slurry, usually about 25% to 30% solids, is vacuum-formed in special molds for depositing ceramic fibers on the surfact of a fine mesh screen. The wet casting is then released after the desired shape and thickness are obtained and on drying it becomes a usable shape of felted or matted fibers. Vacuum-forming can be used effectively for producing a wide variety of complex refractory configurations and sizes and is preferred in fabricating the ceramic plugs of the invention. For a full and complete review of refractory fibers, reference is made to Kirk-Othmer Encyclopedia of Chemical Technology, 2nd edition, Vo. 17 pages 285–295.

In carrying out the plugging operation by the process herein, the vacuum cast ceramic plug is placed over a heat resistant backing or support plug attached to a suitable length pipe handle. This assembly is then employed to plug the furnace taphole. The backing plug is retained in place until sufficient molten furnace material has solidified against the ceramic plug to effect sealing of the taphole.

Preferably, plugs of the invention are formed in the shape of cones having wall thicknesses from ¼ inch to ½ inch. These are obtained by vacuum casting a slurry of alumina-silica (kaolin) fibers such as the ceramic fibers manufactured by the Carborundum Company under the trademark Fiberfrax. The melting point of this product is 3260° F; density range 14–40 lbs/cu. ft. and specific heat 0.27 BTU/lb° F.

The plugging depth of the tapping block can be changed through design variations of the ceramic cone or by stacking one or more cones.

The backing plug must be capable of withstanding the thermal and mechanical stresses encountered during the tapping operation. Suitable plug materials include both metal and non-metals having the requisite structural strength and temperature resistance. Exemplary plugs are made of steel or graphite or combinations thereof.

Vacuum-molted ceramic plugs are ideal for sealing tapholes in phosphorus furnaces because they are dry thereby eliminating danger of splattering molten material as the result of moisture. Moreover, such plugs are flexible and compressable and thus conform to irregularities in the furnace tapholes, creating a positive seal and stopping flow of molten material.

IN THE DRAWINGS:

FIG. 1 is a side elevation view of an electric phosphorus furnace having inserted in the tapholes thereof, the ceramic plugs of the invention, FIG. 2 is a cross sectional view of the furnace wall of FIG. 1 showing a taphole with the ceramic plug of the invention in place and supported by a backing plug.

FIG. 3 shows an enlarged view of the ceramic plug of the invention and having the general configuration of a cone.

FIG. 4 shows another example of the ceramic plug of the invention in the shape of a double taper cone.

Referring to the drawings, FIG. 1 is a view of an electric phosphorus furnace 12 with its tapholes closed with the ceramic plugs 36 of the invention. The phosphorus furnace includes downwardly extending electrodes 13, feed chutes 14, through which a charge is fed to the furnace 12 and a duct 15 through which gases are conveyed from the interior of the furnace. The wall 17 of the furnace is stainless steel and lined on the inside with several courses of carbon brick. Graphite sleeves 18 are spaced around the furnace and extend through the walls thereof. The sleeves have a central bore through which the molten slag or ferrophos is drained during the tapping operation. The sleeves are designed to be replaced after the holes become eroded and enlarged. In use, the tapping sleeves are plugged and the plugs periodically opened using an oxygen lance to remove excess molten furnace material. The ceramic plugs 36 of the invention offer little resistance when opening the tap.

FIG. 2 is a section through the phosphorus furnace wall 17 having a stainless steel shell 3 lined with several courses of carbon brick of FIG. 1. A ceramic plug 36 of the invention is situated in taphole opening 34 of graphite sleeve 18. The insertion assembly 37 consists of a handle **37*b* attached to the base of a heat resistant backing plug 37*a* which is made of heat resistant substance such as graphite, steel or the like. Plugging of taphole 34 is carried out by placing the ceramic plug 36 over insertion assembly 37 which is then introduced into taphole 34. Insertion assembly 37 is retained in place until the molten material has solidified around ceramic plug 36 thereby effecting sealing of taphole 34**.

The ceramic plug 36 is made of the aforedescribed alumina-silica vacuum molded fibers.

What is claimed is:

1. A method of plugging tapholes in a phosphorus furnace comprising the steps:

a. providing a hollow plug member having walls of matted refractory ceramic fibers and conforming generally, at its point of contact, to the opening of the taphole, said member containing at least one hollow end and adapted to receive a supportive backing plug through said hollow end;

b. placing the hollow plug member over a rigid, heat resistant supportive backing plug adapted to make contact with the inner surface of the hollow plug member;

c. inserting the hollow plug member while mounted on the supportive backing plug into the taphole and applying sufficient force to effect a seal between the outer walls of said hollow plug member and taphole opening;

d. retaining the backing plug in place until sufficient molten furnace material solidifies against the the hollow plug member thereby plugging the taphole, and e. removing the backing plug.

2. A method according to claim 1 wherein the plug member is in the shape of a cone.

3. The method according to claim 2 wherein the backing plug is steel.

4. The method according to claim 2 wherein the refractory ceramic fibers are kaolin fibers.

* * * * *